US007229509B2

(12) United States Patent
Cho

(10) Patent No.: US 7,229,509 B2
(45) Date of Patent: Jun. 12, 2007

(54) AL-CU-LI-MG-AG-MN-ZR ALLOY FOR USE AS STRUCTURAL MEMBERS REQUIRING HIGH STRENGTH AND HIGH FRACTURE TOUGHNESS

(75) Inventor: Alex Cho, Charleston, WV (US)

(73) Assignee: Alcan Rolled Products Ravenswood, LLC, Ravenswood, WV (US)

( * ) Notice: Subject to any disclaimer, the term of this patent is extended or adjusted under 35 U.S.C. 154(b) by 0 days.

(21) Appl. No.: 10/853,721

(22) Filed: May 26, 2004

(65) Prior Publication Data

US 2005/0006008 A1 Jan. 13, 2005

Related U.S. Application Data

(60) Provisional application No. 60/473,443, filed on May 28, 2003.

(51) Int. Cl.
*C22C 21/12* (2006.01)

(52) U.S. Cl. ..... 148/417; 420/533; 420/539

(58) Field of Classification Search ..... 148/417; 420/533, 539, 543, 553
See application file for complete search history.

(56) References Cited

U.S. PATENT DOCUMENTS

| | | | |
|---|---|---|---|
| 5,032,359 | A | 7/1991 | Pickens |
| 5,234,662 | A | 8/1993 | Balmuth |
| 5,389,165 | A | 2/1995 | Cho |

OTHER PUBLICATIONS

"International Alloy Designations and Chemical Composition Limits for Wrought Aluminum and Wrought Aluminum Alloys", Aluminum Assocation, 1997, p. 5, 12.

*Primary Examiner*—Roy King
*Assistant Examiner*—Janelle Morillo
(74) *Attorney, Agent, or Firm*—Womble, Carlyle

(57) ABSTRACT

An improved aluminum lithium alloy comprising 0.1 to 2.5 wt. % Li, 2.5 to 5.5 wt. % Cu, 0.2 to 1.0 wt. % Mg, 0.2 to 0.8 wt. % Ag, 0.2 to 0.8 wt. % Mn, up to 0.4 wt. % Zr or other grain refiner such as chromium, titanium, hafnium, scandium or vanadium, the balance aluminum. The present alloy exhibits an improved combination of strength and fracture toughness, over any thickness range. The present invention is further directed to methods for preparing and using Al—Li alloys as well as to products comprising the same.

16 Claims, No Drawings

AL-CU-LI-MG-AG-MN-ZR ALLOY FOR USE AS STRUCTURAL MEMBERS REQUIRING HIGH STRENGTH AND HIGH FRACTURE TOUGHNESS

CROSS REFERENCE TO RELATED APPLICATIONS

The present application claims priority from U.S. Provisional Ser. No. 60/473,443, filed May 28, 2003, the content of which is incorporated herein by reference in its entirety.

BACKGROUND OF THE INVENTION

1. Field of the Invention

The present invention relates to aluminum-lithium based alloy products, particularly those suitable for use as structural members in aircraft construction, such as in bulkhead, spars, wing skin, frames, extruded structural members, and fuselage applications, as well as other applications where a combination of high strength and high fracture toughness are typically desirable and/or required.

2. Description of Related Art

In many industries and particularly in the aircraft industry, reducing the weight of structures has always been a concern. One effective way of doing this is to reduce the density of aluminum alloys used in such structures. It is well known in the art that aluminum alloy densities may be reduced by the addition of lithium. However, it is also known that some problems arise when lithium is added to aluminum based alloys. One of the problems encountered is the possible decrease in ductility and fracture toughness.

Most structural applications in the aircraft industry, and particularly applications such as products intended for use in lower wing skin structures, require a high level of strength, as well as a high level of fracture toughness. It is also desirable for aircraft and other similar applications, that ductility and corrosion behavior remain at an acceptable level.

Among aluminum-lithium based alloys, Al—Cu—Li—Mg—Ag alloys are well-known in the prior art for their interesting properties. Specifically, U.S. Pat. No. 5,032,359 discloses an alloy with a broad composition of 2.0 to 9.8 wt. % of an alloying element, which may be copper, magnesium, or mixtures thereof, the magnesium being at least 0.05 wt. %, from about 0.01 to about 2.0 wt. % silver, from about 0.2 to about 4.1 wt. % lithium, and from about 0.05 to about 1.0 wt. % of a grain refining additive selected from zirconium, chromium, manganese, titanium, boron, hafnium, vanadium, titanium diboride, and mixtures thereof.

U.S. Pat. No. 5,389,165 discloses a preferred composition of 1.10 wt. % Li, 3.61 wt. % Cu, 0.33 wt. % Mg, 0.40 wt. % Ag and 0.14 wt. % Zr. An alloy composition corresponding to such a range was registered at The Aluminum Association in June 2000 as AA 2098. This alloy exhibits high fracture toughness and strength at elevated temperatures, after having been subjected to a specific process. An alloy as disclosed in the '165 patent may be suitable for some thin or medium gauge plate products used in aircraft structures, but may be less suitable for use as thick gauge plates, because of rather low mechanical properties in the ST direction.

Another aluminum-lithium based alloy has also been proposed for thick gauges. This alloy, registered at The Aluminum Association as AA 2297 in August 1997, contains lithium, copper, manganese, and optionally magnesium, but no silver. U.S. Pat. No. 5,234,662 discloses a preferred composition of 1.6 wt. % Li, 3.0 wt. % Cu, 0.3 wt. % Mn, 0.12 wt. % Zr. The alloy, produced in thick gauges, exhibits a good combination of low density, strength, toughness, fatigue resistance and corrosion resistance.

SUMMARY OF THE INVENTION

An object of the present invention was to provide a low density, high strength, high fracture toughness aluminum alloy, which advantageously contains lithium, copper, magnesium, silver, manganese, and a grain refiner, preferably zirconium. Alloys of the present invention are particularly suitable for many if not all structural applications in aircraft, over a wide range of product thicknesses. Because the inventive alloy exhibits improved properties in virtually any thickness range, the inventive product can be used in virtually all forms and for all applications, such as sheets, plates, forgings and extrusions. It can also be machined to form structural members such as spars; it is also suitable for use in welded assemblies.

The present invention comprises an Al—Cu—Li—Mg—Ag—Mn—Zr alloy and demonstrates an unexpected and surprising effect, inter alia relating to the addition of a small amount of manganese to Al—Cu—Li—Mg—Ag—Zr alloys. The addition of a small amount of Mn to an Al—Cu—Li—Mg—Ag—Zr alloy improves the fracture toughness of the alloy at a similar strength level.

Thus, there is provided by the present invention an improved aluminum lithium alloy comprising 0.1 to 2.5 wt. % Li, 2.5 to 5.5 wt. % Cu, 0.2 to 1.0 wt. % Mg, 0.2 to 0.8 wt. % Ag, 0.2 to 0.8 wt. % Mn, up to 0.4 wt. % Zr and/or other grain refiner such as chromium, titanium, hafnium, scandium or vanadium, with the balance aluminum and inevitable elements and impurities such as silicon, iron and zinc. The present alloy exhibits an improved combination of strength and fracture toughness, over virtually any thickness range.

The present invention is further directed to methods for preparing and using Al—Li alloys as well as to products comprising the same.

Additional objects, features and advantages of the invention will be set forth in the description which follows, and in part, will be obvious from the description, or may be learned by practice of the invention. The objects, features and advantages of the invention may be realized and obtained by means of the instrumentalities and combination particularly pointed out in the appended claims.

DETAILED DESCRIPTION OF A PREFERRED EMBODIMENT

In the present invention, it was discovered that minor additions of manganese to Al—Cu—Mg—Ag alloys suitable for thin gauges, such as AA 2098, unexpectedly provided improved results, inter alia in terms of fracture toughness. It was also discovered that a minor addition of magnesium or silver to Al—Cu—Li—Mn—Zr alloys such as AA 2297, which is more suitable for thick gauges, also unexpectedly provided improved strength while possessing similar or even higher fracture toughness. Potentially even more importantly, the present alloy has improved strength and fracture toughness in the ST direction, which is very often a critical direction for certain applications such as very thick plates applications. Therefore, the present inventive alloy, which in some embodiments comprises certain preferred amounts of magnesium, silver and manganese, surprisingly shows better properties in thin, medium and thick gauge applications, than the closest alloys from the prior art.

A copper content between about 3 to about 4 wt. %, and a lithium content between 0.8 and 1.5 wt. % are preferred. In one preferred embodiment, the lithium content is between about 0.9 and about 1.3 wt. %. In the new inventive alloy, magnesium in the range of about 0.2 to about 1 wt. %, preferably from 0.3 to 0.5 wt. %, silver in the range of about 0.2 to about 0.8 wt. % and preferably from 0.3 to 0.5 wt. %, and manganese in the range of about 0.2 wt. % to about 0.8 wt. %, and preferably from 0.3 to 0.5 wt. %, produces an alloy having surprisingly high strength and high fracture toughness. This will become apparent in the examples provided below, where the new alloy will be compared to Al—Cu—Li—Mg—Ag—Zr alloy products such as AA 2098 alloy products, which are used for thin gauge products, and will also be compared to Al—Cu—Li—Mn—Zr alloy products such as AA 2297 alloy products, which are currently used for thick gauge products.

The composition of the present inventive alloy may also optionally include minor amounts of grain refinement elements such as zirconium, chromium, titanium, hafnium, scandium and/or vanadium, that is, particularly up to about 0.3 wt. % of Zr, up to about 0.8 wt. % of Cr, up to about 0.12 wt. % of Ti, up to about 1.0 wt. % of Hf, up to about 0.8 wt. % of Sc, up to about 0.2 wt. % of V are envisioned. A zirconium content between about 0.05 and 0.15 wt. % is preferred. In one preferred embodiment, the total amount of grain refining elements advantageouly does not exceed about 0.25 wt. %. A preferred embodiment of the present invention is an alloy comprising between about 0.8 and about 1.2 wt. % of lithium.

The present alloy is preferably provided as an ingot or billet by any suitable casting technique known in the art. Ingots or billets may be preliminary worked or shaped if desired for any reason to provide suitable stock for subsequent operations. The alloy stock can then be processed in a classical way, such as by performing one or more homogenization operations, hot rolling steps, solution heat treatment, a water quench, stretching, and one or more aging steps to reach peak strength.

According to the present invention, it is possible to obtain a thick (typically at least about 3 inches (76.2 mm) thick) aluminum based alloy product that exhibits in a solution heat-treated, quenched, stress-relieved and artificially aged condition, at least one set of properties selected from the group consisting of:

(a) UTS (L)>70 ksi (482.6 MPa) and $K_{IC}$(L)>34 ksi $\sqrt{\text{inch}}$ (37.4 MPa$\sqrt{m}$)
(b) TYS (L)>65 ksi (448.2 MPa) and $K_{IC}$(L)>34 ksi $\sqrt{\text{inch}}$ (37.4 MPa$\sqrt{m}$)
(c) UTS (LT)>70 ksi (482.6 MPa) and $K_{IC}$(L-T)>27 ksi $\sqrt{\text{inch}}$ (29.7 MPa$\sqrt{m}$)
(d) TYS (LT)>62 ksi (427.5 MPa) and $K_{IC}$(L-T)>26 ksi $\sqrt{\text{inch}}$ (28.6 MPa$\sqrt{m}$)
(e) UTS (ST)>70 ksi (482.6 MPa) and $K_{IC}$(S-T)>24 ksi $\sqrt{\text{inch}}$ (26.4 MPa$\sqrt{m}$)
(f) TYS (ST)>60 ksi (413.7 MPa) and $K_{IC}$(S-T)>23 ksi $\sqrt{\text{inch}}$ (25.3 MPa$\sqrt{m}$).

According to another embodiment of the present invention, it is possible to obtain an aluminum based alloy rolled product with a thickness of less than about 3 inches, that exhibits in a solution heat-treated, quenched, stress-relieved and artificially aged condition, at least one set of properties selected from the group consisting of:

(a) UTS (L)>76 ksi (524.0 MPa) and $K_{IC}$(L)>35 ksi $\sqrt{\text{inch}}$ (38.5 MPa$\sqrt{m}$)
(b) TYS (L)>71 ksi (489.5 MPa) and $K_{IC}$(L)>35 ksi $\sqrt{\text{inch}}$ (38.5 MPa$\sqrt{m}$)
(c) UTS (LT)>75 ksi (517.1 MPa) and $K_{IC}$(L-T)>29 ksi $\sqrt{\text{inch}}$ (31.9 MPa$\sqrt{m}$)
(d) TYS (LT)>68 ksi (468.8 MPa) and $K_{IC}$(L-T)>29 ksi $\sqrt{\text{inch}}$ (31.9 MPa$\sqrt{m}$)
(e) UTS (ST)>76 ksi (524.0 MPa) and $K_{IC}$(S-T)>26 ksi $\sqrt{\text{inch}}$ (28.6 MPa$\sqrt{m}$)
(f) TYS (ST)>65 ksi (448.2 MPa) and $K_{IC}$(S-T)>26 ksi $\sqrt{\text{inch}}$ (28.6 MPa$\sqrt{m}$).

The following examples are provided to illustrate the invention but the invention is not to be considered as being limited thereto. In these examples and throughout this specification, parts are by weight unless otherwise indicated. Also, compositions include normal and/or inevitable impurities, such as silicon, iron and zinc.

EXAMPLE 1

An alloy according to the invention, referenced A1, was produced in gauge 2.5 inches, and compared to an Al—Cu—Li—Mg—Ag—Zr (AA 2098) alloy plate, referenced B1. Actual compositions of cast alloy A1 and B1 products are provided in Table 1 below. Alloy B1 was produced in thinner gauge of 1.7 inches (43.2 mm), because the properties of this alloy in 2.5 inch (63.5 mm) gauge, especially its fracture toughness in ST direction are too poor to enable the product to be a viable commercial product.

Alloy A1 product was processed according to a prior art practice to obtain a plate in a peak aged temper. Namely, alloy A1 product was homogenized for 24 hours at 980° F. (526.7° C.), hot rolled at a temperature range of 780 to 900° F. (415.6-482.2° C.) to obtain a 2.5 inch (63.5 mm) gauge, then solution heat treated at 980° F. (526.7° C.) for 2 hours, then water quenched, stretched at a level of 3%, and artificially aged for 48 hours at 290° F. (155.3° C.) in order to reach the peak strength (T8 temper).

Alloy B1 plate was also homogenized for 24 hours at 980° F. (526.7° C.), hot rolled at a temperature range of 780 to 900° F. (415.6-482.2° C.) to obtain a 1.7 inches (43.2 mm) thick plate, then solution heat treated at 980° F. (526.7° C.) for 2 hours, water quenched, stretched at a level of 3%, and artificially aged for 17 hours at 320° F. (160.0° C.), in order to reach the peak strength (T8 temper).

Respective Ultimate Tensile strength (UTS), Tensile Yield Strength (TYS), and Elongation (E) of alloy A1 and B1 samples were determined in L, LT, and ST directions according to ASTM B557. The fracture toughness of alloy A1 and B1 were determined, using the method of evaluation of the plain-strain Fracture Toughness ($K_{IC}$), according to ASTM E399. This method is appropriate when in plain-strain deformation, which is applicable for the samples analyzed in this example, since these samples are relatively thick (over 1 inch (25.4 mm) thick). All results for alloy A1 and B1 samples are provided in Table 2 below. Most of these values are average values for two duplicate tests on the same plate sample.

TABLE 1

Compositions of cast alloys A1 and B1 in wt. %

| | Cu | Li | Mg | Ag | Zr | Mn |
|---|---|---|---|---|---|---|
| Alloy A1 sample (invention) | 3.59 | 0.9 | 0.34 | 0.30 | 0.09 | 0.43 |
| Alloy B1 sample | 3.58 | 0.99 | 0.34 | 0.34 | 0.14 | <0.01 |

TABLE 2

Mechanical Properties of inventive alloy A1 (thickness 2.5 inches (63.5 mm)) compared to alloy B1 (thickness 1.7 inches (43.2 mm))

| | Direction of measurement | UTS (ksi) [MPa] | TYS (ksi) [MPa] | E (%) | $K_{1C}$ (ksi $\sqrt{inch}$) [MPa$\sqrt{m}$] |
|---|---|---|---|---|---|
| Sample A1 - 2.5 inches (63.5 mm) thick (invention) | L | 80.6 [555.7] | 77.0 [530.9] | 10 | 39.5 [43.4] |
| | LT | 78 [537.8] | 71.0 [489.5] | 9.5 | 30.9 [34.0] |
| | ST | 77.9 [537.1] | 67.0 [462.0] | 5.6 | 27.5 [30.2] |
| Sample B1 - 1.7 inches (43.2 mm) thick | L | 80.6 [555.7] | 76.3 [526.1] | 14.5 | 31.1 [34.2] |
| | LT | 80.5 [555.0] | 74 [510.2] | 11 | 28.4 [31.2] |
| | ST | 83.3 [574.3] | 70.3 [484.7] | 6.4 | 24.9 [27.4] |

The alloy plate according to the invention exhibits better fracture toughness in all three directions, as compared with those from sample B1 from the prior art, with similar strengths in L, LT and ST directions. Fracture Toughness of the present alloy is unexpectedly improved by up to 27% in the L direction (or even greater), by up to or more than 10% in the ST direction, and by up to or more than 8% in the LT direction.

EXAMPLE 2

An Al—Cu—Li—Mn—Zr alloy plate from the prior art (AA 2297 alloy), referenced B2, was produced in a thicker gauge than in example 1; namely thickness of plate B2 was 5 inches (127 mm). Alloy B2 plate was compared to alloy A1 according to the invention, which was also produced in thicker gauge, namely 5 inches (127 mm). Samples of A1 alloy in 5 inches (127 mm) gauge are referenced as A2 in this example. The actual composition of cast alloy A2 and B2 products is provided in Table 3 below.

Alloy A2 plate was processed according to a prior art practice to obtain a plate in T8 temper. Namely, alloy A2 ingot was homogenized for 24 hours at 980° F. (526.7° C.), hot rolled at a temperature range of 800 to 900° F. (426.7-482.2° C.), then solution heat treated at 980° F. (526.7° C.) for 3.5 hours, then water quenched, stretched at a level of 3%, and artificially aged for 40 hours at 290° F. (143.3° C.) in order to reach the peak strength (T8 temper).

Alloy B2 plate was also processed according to a prior art practice to obtain a plate in T8 temper. Namely, alloy B2 plate was homogenized for 24 hours at 980° F. (526.7° C.), hot rolled at a temperature range of 800 to 900° F. (426.7-482.2° C.), then solution heat treated at 980° F. (526.7° C.) for 3.5 hours, water quenched, stretched at a level of 6%, and artificially aged for 22 hours at 320° F. (160° C.), in order to reach the peak strength (T8 temper).

Respective Ultimate Tensile strength (UTS), Tensile Yield Strength (TYS), and Elongation (E) of alloy A2 and alloy B2 samples were determined in L, LT, and ST directions according to ASTM B557. The fracture toughness of alloy A2 and B2 were determined, using the well-known method of evaluation of the plain-strain Fracture Toughness ($K_{IC}$), according to ASTM E399. All results for alloy A2 and B2 samples are provided in Table 4 below.

TABLE 3

Composition of cast alloys A2 and B2

| | Cu | Li | Mg | Ag | Zr | Mn |
|---|---|---|---|---|---|---|
| Alloy A2 sample (invention) | 3.59 | 0.9 | 0.34 | 0.30 | 0.09 | 0.43 |
| Alloy B2 sample | 2.89 | 1.17 | — | — | 0.10 | 0.31 |

TABLE 4

Mechanical properties of inventive alloy A2 in 5 inches (127 mm) gauge compared to prior art alloy B2 in 5 inches (127 mm) gauge

| | Direction of measurement | UTS (ksi) [MPa] | TYS (ksi) [MPa] | E (%) | $K_{1C}$ (ksi $\sqrt{inch}$) (MPa$\sqrt{m}$] |
|---|---|---|---|---|---|
| Sample A2 - thick gauge (invention) | L | 73.5 [506.8] | 68.8 [474.4] | 10.8 | 36.0 [39.6] |
| | LT | 73.8 [508.8] | 65 [448.2] | 8.8 | 28.3 [31.1] |
| | ST | 74.3 [512.3] | 64 [441.3] | 6.5 | 26.9 [29.6] |
| Sample B2 - thick gauge | L | 62.4 [430.2] | 57.6 [397.1]] | 11.8 | 36.6 [40.2] |
| | LT | 63.7 [439.3] | 57.3 [395.1] | 8.8 | 29.1 [32.0] |
| | ST | 63.1 [435.1] | 56.6 [390.2] | 4.5 | 22.4 [24.6] |

A2 sample exhibits much higher strength and fracture toughness in the ST direction, which is an important critical direction for very thick gauge plate applications. In L and LT directions, A2 sample exhibits much higher strength at similar fracture toughness than sample B2 from the prior art. Specifically, in the L and LT directions, the strength was improved by about 18% and 14% respectively, at similar fracture toughness levels. In the ST direction, UTS and TYS were increased by about 18% and 13% respectively, while fracture toughness was increased by about 20%.

Additional advantages, features and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

All documents referred to herein are specifically incorporated herein by reference in their entireties.

As used herein and in the following claims, articles such as "the", "a" and "an" can connote the singular or plural.

What is claimed is:

1. An aluminum alloy having improved strength and fracture toughness, said alloy comprising the following alloying elements added thereto:

Cu: 2.5-4.0 wt.%

Li: 0.8-2.5 wt.%

Mg: 0.2-1 wt.%

Ag: 0.2-0.8 wt.%

Mn: 0.2-0.8 wt.% and

Zr: 0.05 -0.3 wt. %;

And wherein the balance is Al and normal and/or inevitable elements and impurities.

2. An alloy according to claim 1, comprising 3 to 4 wt. % copper.

3. An alloy according to claim 1, comprising 0.8 to 1.8 wt. % lithium.

4. An alloy according to claim 3, comprising 0.8 to 1.2 wt. % lithium.

5. An alloy according to claim 1, comprising 0.8 to 1.5 wt. % lithium.

6. An alloy according to claim 1, comprising 0.3 to 0.5 wt. % magnesium.

7. An alloy according to claim 1, comprising 0.3 to 0.5 wt. % silver.

8. An alloy according to claim 1, comprising 0.05 to 0.15% zirconium.

9. A rolled product comprising an aluminum alloy according to claim 8, with a thickness of less than about 3 inches (76.2 mm), exhibiting in a solution heat-treated, quenched, stress-relieved and artificially aged condition at least one set of properties selected from the group consisting of:

(a) UTS (L)>76 ksi (524.0 MPa) and $K_{IC}$(L)>35 ksi$\sqrt{}$inch (38.5 MPa$\sqrt{}$m), (b) TYS (L)>71 ksi (489.5 MPa) and $K_{IC}$(L)>35 ksi$\sqrt{}$inch (38.5 MPa$\sqrt{}$m), (c) UTS (LT)>75 ksi 517.1 MPa) and $K_{IC}$(L-T)>29 ksi$\sqrt{}$inch (31.9 MPa$\sqrt{}$m), (d) TYS (LT)>68 ksi (468.8 MPa) and $K_{IC}$(L-T)>29 ksi$\sqrt{}$inch (31.9 MPa$\sqrt{}$m), (e) UTS (ST)>76 ksi (524.0 MPa) and $K_{IC}$(S-T)>26 ksi$\sqrt{}$inch (28.6 MPa$\sqrt{}$m) and (f) TYS (ST)>65 ksi (448.2 MPa) and $K_{IC}$(S-T)>26 ksi$\sqrt{}$inch (28.6 MPa$\sqrt{}$m).

10. A rolled product comprising an aluminum alloy according to claim 1, with a thickness of at least about 3 inches, exhibiting in a solution heat-treated, quenched, stress-relieved and artificially aged condition, at least one set of properties selected from the group consisting of:

(a) UTS (L)>70 ksi (482.6 MPa) and $K_{IC}$(L)>34 ksi$\sqrt{}$inch (37.4 MPa$\sqrt{}$m), (b) TYS (L)>65 ksi (448.2 MPa) and $K_{IC}$(L)>34 ksi$\sqrt{}$inch (37.4 MPa$\sqrt{}$m), (c) UTS (LT)>70 ksi (482.6 MPa) and $K_{IC}$(L-T)>27 ksi$\sqrt{}$inch (29.7 MPa$\sqrt{}$m), (d) TYS (LT)>62 ksi (427.5 MPa) and $K_{IC}$(L-T)>26 ksi$\sqrt{}$inch (28.6 MPa$\sqrt{}$m), (e) UTS (ST)>70 ksi (482.6 MPa) and $K_{IC}$(S-T)>24 ksi$\sqrt{}$inch (26.4 MPa$\sqrt{}$m) and (f) TYS (ST)>60 ksi (413.7 MPa) and $K_{IC}$(S-T)>23 ksi$\sqrt{}$inch (25.3 MPa$\sqrt{}$m).

11. A structural product comprising an alloy of claim 1.

12. A structural product of claim 11 comprising a rolled product.

13. A structural product of claim 11 comprising a sheet, plate forging, extrusion, spar and/or welded assembly.

14. An alloy of claim 1, that has been subjected to at least one of (i) homogenization, (ii) hot rolling, (iii) solution heat treatment, (iv) water quench, (v) stretching, and/or (vi) aging.

15. An aluminum alloy of claim 1 comprising from 0.3-0.8 Mn.

16. A structural product comprising an alloy of claim 15.

* * * * *

UNITED STATES PATENT AND TRADEMARK OFFICE

CERTIFICATE OF CORRECTION

PATENT NO. : 7,229,509 B2
APPLICATION NO. : 10/853721
DATED : June 12, 2007
INVENTOR(S) : Alex Cho It is certified that error appears in the above-identified patent and that said Letters Patent is hereby corrected as shown below:

At col. 5, line 10, please insert "(L-T)" after 39.5.
At col. 5, line 12, please insert "(T-L)" after 30.9.
At col. 5, line 15, please insert "(L-T)" after 31.1.
At col. 5, line 17, please insert "(T-L)" after 28.4.
At col. 6, line 20, please insert "(L-T)" after 36.0.
At col. 6, line 22, please insert "(T-L)" after 28.3.
At col. 6, line 25, please insert "(L-T)" after 36.6.
At col. 6, line 27, please insert "(T-L)" after 29.1.
At col. 8, line 4, please replace "KIC(L)" with "KIC(L-T)"
At col. 8, line 6, please replace "KIC(L)" with "KIC(L-T)"
At col. 8, line 8, please replace "KIC(L-T)" with "KIC(T-L)"
At col. 8, line 10, please replace "KIC(L-T)" with "KIC(T-L)"

Signed and Sealed this
Twentieth Day of December, 2011

David J. Kappos

David J. Kappos
*Director of the United States Patent and Trademark Office*

Disclaimer 7,229,509 B2—Alex Cho, Charleston, WV (US). NEW AL-CU-LI-MG-AG-MN-ZR ALLOY FOR USE AS STRUCTURAL MEMBERS REQUIRING HIGH STRENGTH AND HIGH FRACTURE TOUGHNESS. Patent dated June 12, 2007. Disclaimer filed November 11, 2011, by the assignee, Constellium Rolled Products Ravenswood, LLC.

Hereby disclaims complete claims 1-9, and 11-16 of said patent.

(*Official Gazette*, September 22, 2015)

US007229509C1

(12) EX PARTE REEXAMINATION CERTIFICATE (40th)

Ex Parte Reexamination Ordered under 35 U.S.C. 257

United States Patent
Cho

(10) Number: US 7,229,509 C1
(45) Certificate Issued: Nov. 12, 2015

(54) AL-CU-LI-MG-AG-MN-ZR ALLOY FOR USE AS STRUCTURAL MEMBERS REQUIRING HIGH STRENGTH AND HIGH FRACTURE TOUGHNESS

(75) Inventor: Alex Cho, Charleston, WV (US)

(73) Assignee: CONSTELLIUM ROLLED PRODUCTS RAVENSWOOD, LLC, Ravenswood, WV (US)

Supplemental Examination Request:
No. 96/000,071, Jul. 3, 2014

Reexamination Certificate for:

| | |
|---|---|
| Patent No.: | **7,229,509** |
| Issued: | **Jun. 12, 2007** |
| Appl. No.: | **10/853,721** |
| Filed: | **May 26, 2004** |

Disclaimer of Claims 1-9 and 11-16
Filed: Sep. 22, 2015 (1418 O.G. 4)

Certificate of Correction issued Dec. 20, 2011

Related U.S. Application Data

(60) Provisional application No. 60/473,443, filed on May 28, 2003.

(51) Int. Cl.
*C22C 21/12* (2006.01)
*C22C 21/16* (2006.01)

(52) U.S. Cl.
CPC ..... *C22C 21/16* (2013.01)

(58) Field of Classification Search
None
See application file for complete search history.

(56) References Cited

To view the complete listing of prior art documents cited during the supplemental examination proceeding and the resulting reexamination proceeding for Control Number 96/000,071, please refer to the USPTO's public Patent Application Information Retrieval (PAIR) system under the Display References tab.

*Primary Examiner* — Krisanne Jastrzab

(57) ABSTRACT

An improved aluminum lithium alloy comprising 0.1 to 2.5 wt. % Li, 2.5 to 5.5 wt. % Cu, 0.2 to 1.0 wt. % Mg, 0.2 to 0.8 wt. % Ag, 0.2 to 0.8 wt. % Mn, up to 0.4 wt. % Zr or other grain refiner such as chromium, titanium, hafnium, scandium or vanadium, the balance aluminum. The present alloy exhibits an improved combination of strength and fracture toughness, over any thickness range. The present invention is further directed to methods for preparing and using Al—Li alloys as well as to products comprising the same.

At the time of issuance and publication of this certificate, the patent remains subject to pending reissue application number 14/071,211 filed Nov. 4, 2013. The claim content of the patent may be subsequently revised if a reissue patent is issued from the reissue application.

EX PARTE REEXAMINATION CERTIFICATE

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-9 and 11-16 were previously disclaimed.

Claim 10 is cancelled.

New claims 17-30 are added and determined to be patentable.

*17. A rolled product comprising an aluminum alloy, having improved strength and fracture toughness, said alloy comprising the following alloying elements added thereto:*

*Cu: 3.0-4.0 wt. %*

*Li: 0.8-1.2 wt. %*

*Mg: 0.2-1 wt. %*

*Ag: 0.2-0.5 wt. %*

*Mn: 0.2-0.8 wt. % and*

*Zr: 0.05-0.3 wt. %;*

*and wherein the balance is Al and normal and/or inevitable elements and impurities, with a thickness of at least about 3 inches, wherein the rolled product exhibits in a solution heat-treated, quenched, stress-relieved and artificially aged condition, at least one set of properties selected from the group consisting of:*

*(e) UTS (ST)>70 ksi (482.6 MPa) and $K_{IC}$(S-T)>24 ksi√inch (26.4 MPa√m) and*

*(f) TYS (ST)>60 ksi (413.7 MPa) and $K_{IC}$(S-T)>23 ksi√inch (25.3 MPa√m).*

*18. The rolled product according to claim 17, wherein said aluminum alloy comprises 0.3-0.5 wt. % Mg.*

*19. The rolled product according to claim 17, wherein said aluminum alloy comprises 0.05 to 0.15% Zr.*

*20. The rolled product according to claim 19, wherein said aluminum alloy comprises 0.3-0.5 wt. % Ag.*

*21. The rolled product according to claim 20, wherein said aluminum alloy comprises 0.3-0.5 wt. % Mn.*

*22. The rolled product according to claim 21, wherein said aluminum alloy comprises 0.3-0.5 wt. % Mg.*

*23. The rolled product according to claim 17, wherein said aluminum alloy comprises 0.3-0.5 wt. % Mn.*

*24. The rolled product according to claim 22, wherein the rolled product exhibits in a solution heat-treated, quenched, stress-relieved and artificially aged condition the following set of properties:*

*(e) UTS (ST)>70 ksi (482.6 MPa) and $K_{IC}$(S-T)>24 ksi√inch (26.4 MPa√m).*

*25. The rolled product according to claim 22, wherein the rolled product exhibits in a solution heat-treated, quenched, stress-relieved and artificially aged condition the following set of properties:*

*(f) TYS (ST)>60 ksi (413.7 MPa) and $K_{IC}$(S-T)>23 ksi√inch (25.3 MPa√m).*

*26. The rolled product of according to claim 17, wherein said rolled product is incorporated into an aircraft structural member.*

*27. A rolled product according to claim 21 produced by a method comprising (i) casting an ingot, (ii) optionally working or shaping the ingot, (iii) one or more homogenization operations, (iv) hot rolling steps, (v) a solution heat treatment, (vi) a water quench, (vii) stretching, and (viii) one or more aging steps.*

*28. The rolled product according to claim 27, wherein said hot rolling steps are performed at a hot rolling temperature from about 780° F. to about 900° F.*

*29. The rolled product according to claim 27, wherein said hot rolling steps are performed at a hot rolling temperature from about 800° F. to about 900° F.*

*30. The rolled product according to claim 17, comprising an aluminum alloy, having improved strength and fracture toughness, said alloy comprising the following alloying elements added thereto:*

*Cu: 3.0-4.0 wt. %*

*Li: 0.8-1.2 wt. %*

*Mg: 0.3-0.5 wt. %*

*Ag: 0.2-0.5 wt. %*

*Mn: 0.3-0.5 wt. % and*

*Zr: 0.05-0.15 wt. %;*

*and wherein the balance is Al and normal and/or inevitable elements and impurities, with a thickness of at least about 3 inches, wherein the rolled product exhibits in a solution heat-treated, quenched, stress-relieved and artificially aged condition, and comprises at least one set of properties selected from the group consisting of*

*(e) UTS (ST)>70 ksi (482.6 MPa) and $K_{IC}$(S-T)>24 ksi√inch (26.4 MPa√m) and*

*(f) TYS (ST)>60 ksi (413.7 MPa) and $K_{IC}$(S-T)>23 ksi√inch (25.3 MPa√m).*

* * * * *